US009483006B2

(12) United States Patent
Miyamoto

(10) Patent No.: US 9,483,006 B2
(45) Date of Patent: Nov. 1, 2016

(54) IMAGE FORMING APPARATUS AND METHOD FOR CONTROLLING IMAGE FORMING APPARATUS

(71) Applicant: KYOCERA Document Solutions Inc., Osaka (JP)

(72) Inventor: Kenji Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/720,724

(22) Filed: May 22, 2015

(65) Prior Publication Data

US 2015/0346668 A1 Dec. 3, 2015

(30) Foreign Application Priority Data

May 28, 2014 (JP) ..... 2014-110491

(51) Int. Cl.

| | |
|---|---|
| ***G03G 15/00*** | (2006.01) |
| ***B65H 31/10*** | (2006.01) |
| ***B65H 31/02*** | (2006.01) |
| ***B65H 43/06*** | (2006.01) |

(52) U.S. Cl.

CPC ..... *G03G 15/6529* (2013.01); *B65H 31/02* (2013.01); *B65H 43/06* (2013.01); *B65H 31/10* (2013.01); *B65H 2301/132* (2013.01); *B65H 2301/16* (2013.01); *B65H 2301/4212* (2013.01); *B65H 2511/17* (2013.01); *B65H 2511/30* (2013.01); *B65H 2801/06* (2013.01); *G03G 15/6573* (2013.01); *G03G 15/6576* (2013.01); *G03G 2215/00911* (2013.01)

(58) Field of Classification Search

CPC ..... G03G 2215/00911; G03G 15/6567; B65H 2301/16; B65H 31/10

See application file for complete search history.

(56) References Cited

U.S. PATENT DOCUMENTS

2011/0182642 A1* 7/2011 Nanayama ..... 399/406
2011/0217058 A1* 9/2011 Honda et al. ..... 399/43

FOREIGN PATENT DOCUMENTS

JP 2001-294362 A 10/2001

* cited by examiner

*Primary Examiner* — Robert Huber
*Assistant Examiner* — John M Royston
(74) *Attorney, Agent, or Firm* — Stein IP, LLC

(57) ABSTRACT

An image forming apparatus includes a discharge tray; a printing unit; a stacking controlling unit that determines a front side value related to toner amount on a front side of a sheet and a back side value related to toner amount on a back side, determines an absolute value of difference between the front side value and the back side value for each sheet, determines a correction value of each sheet based on the absolute value and correction value data, adds the correction value to a predetermined value for determining a corrected count value of each sheet, integrates the corrected count value, and detects full of the discharge tray when the integrated value reaches a predetermined upper limit value; and a storage unit for storing the correction value data in which the correction value is determined corresponding to the absolute value.

5 Claims, 6 Drawing Sheets

FIG.5

| FOR DUPLEX PRINTING | |
|---|---|
| PRINTING RATE DIFFERENCE (ABSOLUTE VALUE, %) | CORRECTION VALUE |
| 0≦1 | 0 |
| 1<X≦10 | 0.1 |
| 10<X≦20 | 0.2 |
| 20<X≦30 | 0.3 |
| 30<X≦40 | 0.4 |
| 40<X≦50 | 0.5 |
| 50<X≦60 | 0.6 |
| 60<X≦70 | 0.7 |
| 70<X≦80 | 0.8 |
| 80<X≦90 | 0.9 |
| 90<X≦100 | 1.0 |
| FOR SIMPLEX PRINTING | |
| PRINTING RATE DIFFERENCE (ABSOLUTE VALUE, %) | CORRECTION VALUE |
| 0≦1 | 0 |
| 1<X≦10 | 0.05 |
| 10<X≦20 | 0.1 |
| 20<X≦30 | 0.15 |
| 30<X≦40 | 0.2 |
| 40<X≦50 | 0.25 |
| 50<X≦60 | 0.3 |
| 60<X≦70 | 0.35 |
| 70<X≦80 | 0.4 |
| 80<X≦90 | 0.45 |
| 90<X≦100 | 0.5 |

D1

D2

D

IMAGE FORMING APPARATUS AND METHOD FOR CONTROLLING IMAGE FORMING APPARATUS

INCORPORATION BY REFERENCE

This application is based upon and claims the benefit of priority from the corresponding Japanese Patent Application No. 2014-110491 filed May 28, 2014, the entire contents of which are hereby incorporated by reference.

BACKGROUND

The present disclosure relates to an image forming apparatus that includes a discharge tray for receiving printed sheets of paper and detects full of the discharge tray.

An image forming apparatus such as a multifunction peripheral, a printer, or a copier is equipped with a discharge tray for receiving printed sheets of paper. There is a limitation of amount (thickness or the number) of sheets of paper that can be stacked on the discharge tray. When sheets of paper are stacked up to a height of a discharging opening for sheet, the stacked sheets of paper may abut a sheet of paper to be discharged next, and hence the discharge thereof is blocked. As a result, jamming of the sheet may occur at the discharging opening portion. In order to prevent such a bad situation, full of the discharge tray may be detected.

There is known an image forming apparatus that detects full of the discharge tray as described below. Specifically, the image forming apparatus performs an image forming process on a plurality of sets of sheets of paper, feeds and conveys the sheets of paper to a compiler tray, outputs a control signal instructing post processing or discharge processing in a period from feeding of the final sheet of paper of one set to feeding of the first sheet of paper of the next set, responds to the control signal so as to perform the post processing on the sheets of paper conveyed to the compiler tray and discharges the sheets of paper to the discharge tray, detects that stacking height of the sheets of paper on the discharge tray has exceeded a permissible stacking height (i.e., detects full of the discharge tray), and outputs a full signal indicating that the discharge tray is full when detecting the full of the discharge tray at the time point when the control signal is received, and stops to feed the first sheet of paper of the next set when receiving the full signal. The full signal is transmitted only in a break between the sets. A false detection of temporary excessing the permissible stacking amount due to curling of the sheet of paper during the process of setting sheets of paper is ignored. This is for a purpose to avoid interruption of the image forming process and to prevent a false detection of excess of the stacking amount on the discharge tray.

As described above as the known technique, it is common to provide the discharge tray with a sensor so as to detect full of the discharge tray. However, when the sensor for detecting full of the discharge tray and a mechanism working in accordance with amount of sheets of paper stacked on the discharge tray are provided, manufacturing cost of the image forming apparatus increases, and the manufacturing process becomes complicated. In order to reduce manufacturing cost of the image forming apparatus, instead of disposing the sensor and the mechanism for detecting full of the discharge tray, the number of sheets of paper discharged onto the discharge tray may be counted so as to detect full of the discharge tray. For instance, the upper limit number of sheets is determined in advance by considering the design number of sheets of paper that can be stacked on the discharge tray.

Then, the number of sheets from start of a printing job is counted (integrated). When the count value reaches an upper limit number of sheets, full of the discharge tray is detected.

Here, an actual thickness of the sheets of paper on the discharge tray varies depending on amount of curl (degree of curl) of discharged sheets of paper. In addition, the amount of curl (state of curl) is related to amount of toner used for the printed image, and the like. For this reason, the amount of curl is affected by content of print and is different for each sheet of paper.

Conventionally, when detecting full of the discharge tray by counting the number of sheets, the apparatus merely and literally counts the number of sheets. Accordingly, there is a problem that the amount of curl (degree of curl) of each sheet of paper is not considered for processing. As a result, in the image forming apparatus of this type that detects full of the discharge tray by counting the number of sheets, sheets of paper stacked on the discharge tray may block the discharging opening for a sheet of paper before the count value reaches the upper limit number of sheets because of a curl of a sheet of paper. When the discharging opening is blocked, jamming of the sheet occurs so that the stacked sheets of paper are disturbed.

It is considered to intentionally set the upper limit number of sheets to a substantially small value so that the discharging opening is not blocked even if the amount of curl is large in detecting full of the discharge tray by counting the number of sheets. However, the number of sheets that can be stacked on the discharge tray is substantially reduced, and hence full of the discharge tray is detected in a state where more sheets of paper can be stacked.

Here, the known image forming apparatus described above, which detects full of the discharge tray by using an actuator or a sensor, is not the type that counts the number of discharged sheets of paper, and therefore cannot solve the above-mentioned problem. In addition, there is a problem that manufacturing cost of the image forming apparatus is higher than that of the type that detects full of the discharge tray by counting the number of sheets.

SUMMARY

The present disclosure is made in view of the above-mentioned problem of the conventional technique. An image forming apparatus according to one aspect of the present disclosure includes a discharge tray, a printing unit, a stacking controlling unit, and a storage unit. The printing unit includes a duplex printing mechanism for performing duplex printing and the printed sheet is discharged onto a discharge tray. The stacking controlling unit includes a counter for integrating a value, and is configured to determine a front side value related to an amount of toner deposited on a front side of the printed sheet and a back side value related to an amount of toner deposited on a back side of the sheet, to determine an absolute value of a difference between the front side value and the back side value of each sheet of paper. The storage unit stores correction value data in which a correction value is determined to be larger as the absolute value is larger. The stacking controlling unit determines the correction value of each sheet of paper discharged onto the discharge tray on the basis of the determined absolute value and the correction value data, integrates a corrected count value obtained by correcting the count value incremented by one every time when the sheet of paper is discharged by the correction value so as to determine an integrated value, and detects full of the discharge tray when the integrated value reaches a predetermined upper limit value.

Further features and advantages of the present invention will become apparent from the description of embodiments given below.

BRIEF DESCRIPTION OF THE DRAWINGS

FIG. 5 is a diagram showing an example of a correction value data for determining a correction value.

DETAILED DESCRIPTION

An embodiment of the present disclosure is now described with reference to FIGS. 1 to 8. However, elements such as structures, layouts, and the like described in the embodiment do not limit the scope of the disclosure and are merely examples for description.

(Outline of Image Forming Apparatus)

Figure 1:
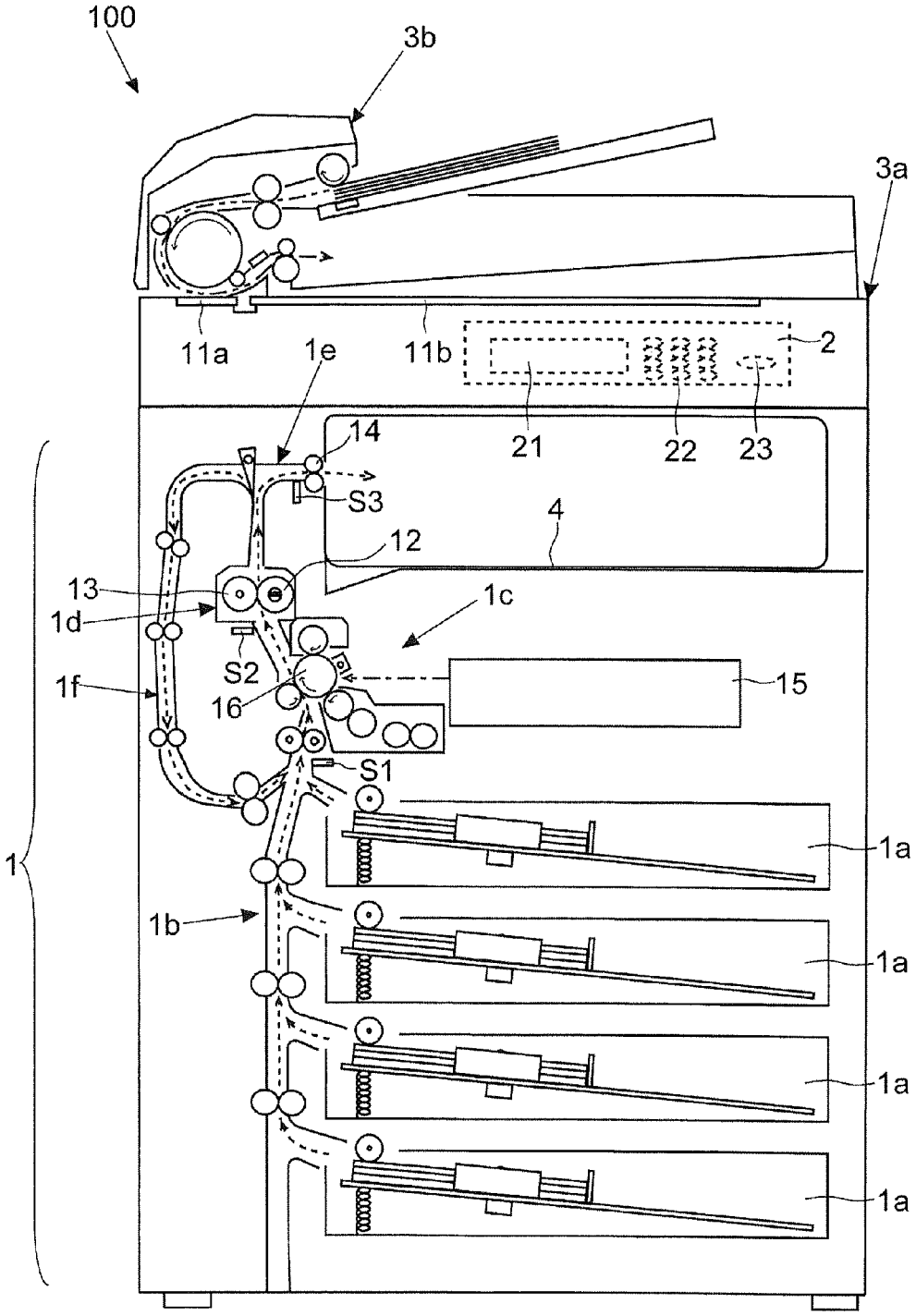
FIG. 1 is a diagram showing an example of a multifunction peripheral according to an embodiment.

First, with reference to FIG. 1, a multifunction peripheral 100 (corresponding to the image forming apparatus) according to an embodiment of the present disclosure is described. FIG. 1 is a diagram showing an example of the multifunction peripheral 100 according to the embodiment. The multifunction peripheral 100 includes a printing unit 1.

An operation panel 2 is disposed on the front face of the multifunction peripheral 100. The operation panel 2 includes menus for setting or instructing operations, and a display unit 21 for displaying software keys (corresponding to an informing unit). In addition, the display unit 21 is a touch panel type. Further, the operation panel 2 is also provided with hardware keys such as a ten-key unit 22 for numerical input and a start key 23 for instructing execution of a job such as copying. A user presses a software key displayed on the display unit 21 or one of the hardware keys so as to perform various setting for duplex printing, simplex printing, and the like. In other words, the display unit 21 accepts setting for performing either the duplex printing or the simplex printing. In addition, the display unit 21 displays messages and information related to the multifunction peripheral 100. For instance, when full of a discharge tray 4 is detected, the display unit 21 displays the full of the discharge tray 4.

The multifunction peripheral 100 of this embodiment includes an image reading unit 3*a* and a document feeder unit 3*b* on an upper part. The multifunction peripheral 100 includes the printing unit 1 for printing on a sheet of paper P using toner, which is disposed in a main body. The printing unit 1 includes a paper sheet feeder 1*a*, a conveying unit 1*b*, an image forming unit 1*c*, a fixing unit 1*d*, a discharge conveying unit 1*e*, and a duplex conveying unit 1*f*.

The document feeder unit 3*b* automatically and successively transports set document sheets one by one to a reading position (feed reading contact glass 11*a*). The image reading unit 3*a* includes the feed reading contact glass 11*a* and a place reading contact glass 11*b*. The image reading unit 3*a* includes a lamp, a mirror, a lens, an image sensor, and the like (not shown). The image reading unit 3*a* reads the document based on light reflected from the document sheet passing through the feed reading contact glass 11*a* or the document placed on the place reading contact glass 11*b*. Then, the image reading unit 3*a* digitizes an analog electric signal from the image sensor so as to generate image data of the document.

The paper sheet feeder 1*a* sends out the sheets of paper P one by one to the conveying unit 1*b* when printing is performed. The conveying unit 1*b* conveys the sheet of paper P in the apparatus. The image forming unit 1*c* forms a toner image based on image data read by the image reading unit 3*a* or image data stored in a storage unit 6 described later, and transfers the toner image onto the sheet of paper P. The fixing unit 1*d* includes a heating roller 12 configured to heat and contact with an unfixed toner image, and a pressure roller 13 pressed to contact with the heating roller 12. When passing through a nip between the heating roller 12 and the pressure roller 13, the toner image is heated and pressed so as to be fixed to the sheet of paper P. The sheet of paper P discharged from the fixing unit 1*d* is sent to the discharge conveying unit 1*e*. The discharge conveying unit 1*e* switches the conveying direction of the printed sheet of paper P to the discharge tray 4 or to the duplex conveying unit 1*f*. Then, a pair of discharge rollers 14 of the discharge conveying unit 1*e* conveys the sheet of paper P (after passing through the fixing unit 1*d* in the simplex printing or after fixing toner images to both sides of the sheet of paper P in the duplex printing) to the discharge tray 4. As a result, the sheet of paper P is discharged from a discharging opening 1*g* onto the discharge tray 4.

In the duplex printing, the pair of discharge rollers 14 switch back the sheet of paper P having one printed side so as to guide the sheet of paper P having the other unprinted side to the duplex conveying unit 1*f*. The duplex conveying unit if conveys the entering sheet of paper P having one printed side to an upstream of the image forming unit 1*c*. Thus, the discharge conveying unit 1*e* and the duplex conveying unit if constitute a duplex printing mechanism for performing the duplex printing.

(Hardware Structure of Multifunction Peripheral 100 Etc.)

Figure 2:
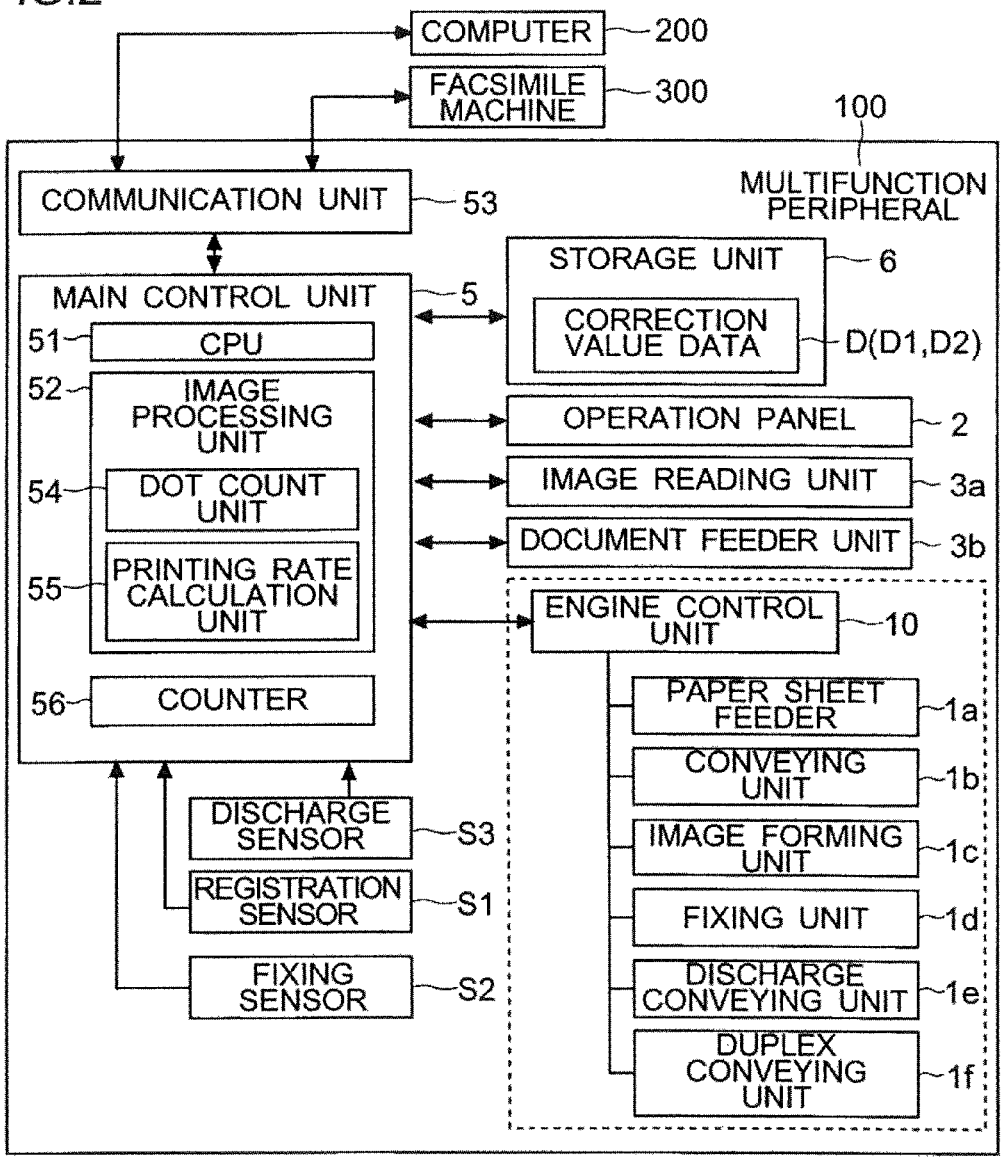
FIG. 2 is a block diagram showing an example of a hardware structure of the multifunction peripheral.

Next, with reference to FIG. 2, a hardware structure of the multifunction peripheral 100 and the like according to the embodiment is described. FIG. 2 is a block diagram showing an example of a hardware structure of the multifunction peripheral 100 and the like.

A main control unit 5 (corresponding to a stacking controlling unit) is disposed in the main body of the multifunction peripheral 100. The main control unit 5 is connected to the operation panel 2, the document feeder unit 3*b*, the image reading unit 3*a*, and the printing unit 1, so as to control them. In addition, the multifunction peripheral 100 is provided with an engine control unit 10 configured to perform operation control (print control) of the printing unit 1.

The main control unit 5 includes a CPU 51 and an image processing unit 52 (e.g., an ASIC). In addition, the main control unit 5 (CPU 51) performs calculation and the like on the basis of a control program and control data stored in the storage unit 6, so as to control each unit of the multifunction peripheral 100. In addition, the main control unit 5 provides the engine control unit 10 with an instruction, data and information of a printing job to be executed when printing is performed, so that the engine control unit 10 performs the printing. The engine control unit 10 controls operation of each part of the printing unit 1 in accordance with the instruction, data, and information received from the main control unit 5.

The storage unit 6 is a combination of storage devices such as a ROM, a RAM, and an HDD. The storage unit 6 stores a control program of the multifunction peripheral 100 and various data such as control data, setting data, and image data. As for the present disclosure, the storage unit 6 stores correction value data D for detecting full of the discharge tray 4 (details will be described later).

Further, the main control unit 5 is connected to a communication unit 53 including various connectors, sockets, a communication circuit, and a FAX modem. The communication unit 53 is connected to a plurality of external computers 200 (personal computers and servers) and facsimile machines 300 via a network, a public line, or the like (only one of each is shown in FIG. 2 for convenience sake). The image data obtained by the image reading unit 3*a* can be transmitted to the external computer 200 or the facsimile machine 300 on the other side (as a scanner function or a FAX function). In addition, it is possible to print on the basis of the image data transmitted from the computer 200 or the facsimile machine 300 and supplied to the multifunction peripheral 100 (as a printer function or the FAX function).

In addition, the main control unit 5 recognizes an input from the operation panel 2 and controls the multifunction peripheral 100 so that the printing job such as copying or the transmission job is performed in accordance with the user setting. When the setting for performing the duplex printing is made with the operation panel 2, the main control unit 5 controls the printing unit 1 to perform the duplex printing. When the setting for performing the simplex printing is made, the main control unit 5 controls the printing unit 1 to perform printing only on one side of the sheet of paper P.

In addition, in the multifunction peripheral 100, there is provided the image processing unit 52 configured to perform image processing on the image data generated by the image reading unit 3*a* or the image data received by the communication unit 53. In printing, the image processing unit 52 performs image processing corresponding to the setting made with the operation panel 2 and generates image data for exposing a photosensitive drum 16 (see FIG. 1) by an exposing device 15, so as to transmit the generated image data to the image forming unit 1*c*.

Then, the image processing unit 52 can be provided with a dot count unit 54 configured to count dots on which toner is deposited on the basis of the image data for exposing in a page of the sheet of paper P. In addition, the image processing unit 52 may be provided with a printing rate calculation unit 55 configured to calculate a printing rate based on the dot count. The calculations of the dot count and the printing rate based on the image data may be performed by the CPU 51. Note that the image processing unit 52 can perform various types of image processing such as rotation, scaling, density change, and aggregating, besides the dot count.

In addition, the multifunction peripheral 100 is provided with a plurality of sheet detection sensors for detecting a conveying situation of the sheet of paper P disposed along a conveying path for the sheet of paper P (see FIG. 2). One of the sheet detection sensors (registration sensor S1) is disposed before the image forming unit 1*c*, another one (fixing sensor S2) is disposed at an entrance of the fixing unit 1*d*, and still another one (discharge sensor S3) is disposed before the pair of discharge rollers 14 in a sheet conveying direction (near the discharging opening 1*g*). The discharge sensor S3 is a sensor for detecting whether or not the sheet of paper P has reached to the discharging opening 1*g* and the printed sheet of paper P is discharged onto the discharge tray 4. Further, the main control unit 5 is provided with a counter 56 for integrating a value. A basic count value is one corresponding to discharge of one sheet of paper. The main control unit 5 counts with the counter 56 a value related to the discharged sheets of paper P onto the discharge tray 4.

Each sheet detection sensor (the registration sensor S1, the fixing sensor S2, or the discharge sensor S3) is an optical sensor or a switch that is turned on or off depending on whether or not the sheet of paper P exists. An output of each sheet detection sensor is supplied to the main control unit 5, and hence the main control unit 5 can detect a conveying situation of the sheet of paper P (arrival or passing of the sheet of paper P at the sensor position).

(Curl of Sheet of Paper P)

Figure 3:
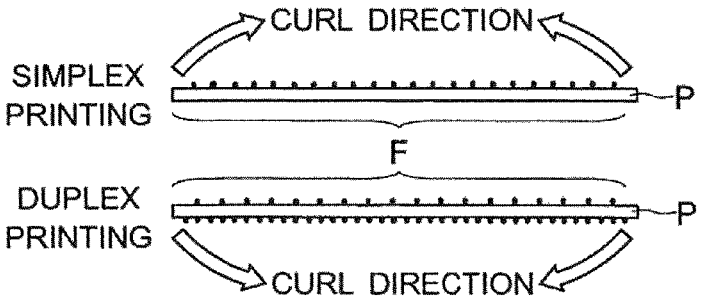
FIG. 3 is a diagram for explaining a curl of a sheet of paper.

Next, with reference to FIG. 3, a curl of the sheet of paper P is described. FIG. 3 is a diagram for explaining a curl of the sheet of paper P. Further, in the following description, the image data for printing can be the image data obtained by reading with the image reading unit 3*a*, the image data transmitted from the external computer 200, or the image data stored in the storage unit 6.

There are various factors causing a curl of the sheet of paper P. One of the factors is contraction of toner in the fixing process (when toner is heated and pressed). When the amount of toner is larger, the amount of contraction of toner is larger. Accordingly, the sheet of paper P is apt to curl toward the direction of the side with larger amount of toner. In addition, toner heated in the fixing process becomes more adhesive so that the sheet of paper P may be wound around a rotating member such as the heating roller 12 of the fixing unit 1*d* so as to be curled.

In addition, when the sheet of paper P is heated, moisture is evaporated from the sheet of paper P. As a result, the sheet of paper P may be contracted (for example, the sheet of paper P is warped). For this reason, a difference of moisture between both sides of the sheet of paper P or a difference of evaporation amount of moisture between both sides of the sheet of paper P may be a factor causing a curl of the sheet of paper P. Specifically, because of continuous printing on the sheets of paper P or toner deposited on the sheet of paper P, the temperature of the pressure roller 13 (backside of the printed side) becomes lower than that of the heating roller 12, and hence the evaporation amount of the printed side may be larger. A difference of moisture amount between both sides of the sheet of paper P may cause a difference of the contraction degree between both sides of the sheet of paper P resulting in occurrence of a curl.

As shown in the upper diagram of FIG. 3, in the simplex printing, the sheet of paper P is usually curled toward the side on which toner (shown by dots in FIG. 3) is deposited. In each diagram of FIG. 3, a white arrow indicates an example of a curl direction of the sheet of paper P.

On the other hand, in the duplex printing, the sheet of paper P is usually curled toward the side on which more toner is deposited as shown in the lower diagram of FIG. 3. The reason is considered to be as follows. Both sides of the sheet of paper P are heated (when contacting with the heating roller 12), and moisture is evaporated from both sides of the sheet of paper P. As a result, contraction of toner is apt to affect largely.

The lower diagram of FIG. 3 shows that amount of toner deposited on the lower side is larger than that on the upper side when whole pages are compared. Further, the lower diagram of FIG. 3 shows that the sheet of paper P is curled toward the lower side on which more toner is deposited.

(Detection of Full of Discharge Tray 4 by Considering Curl of Sheet of Paper P)

Figure 4:
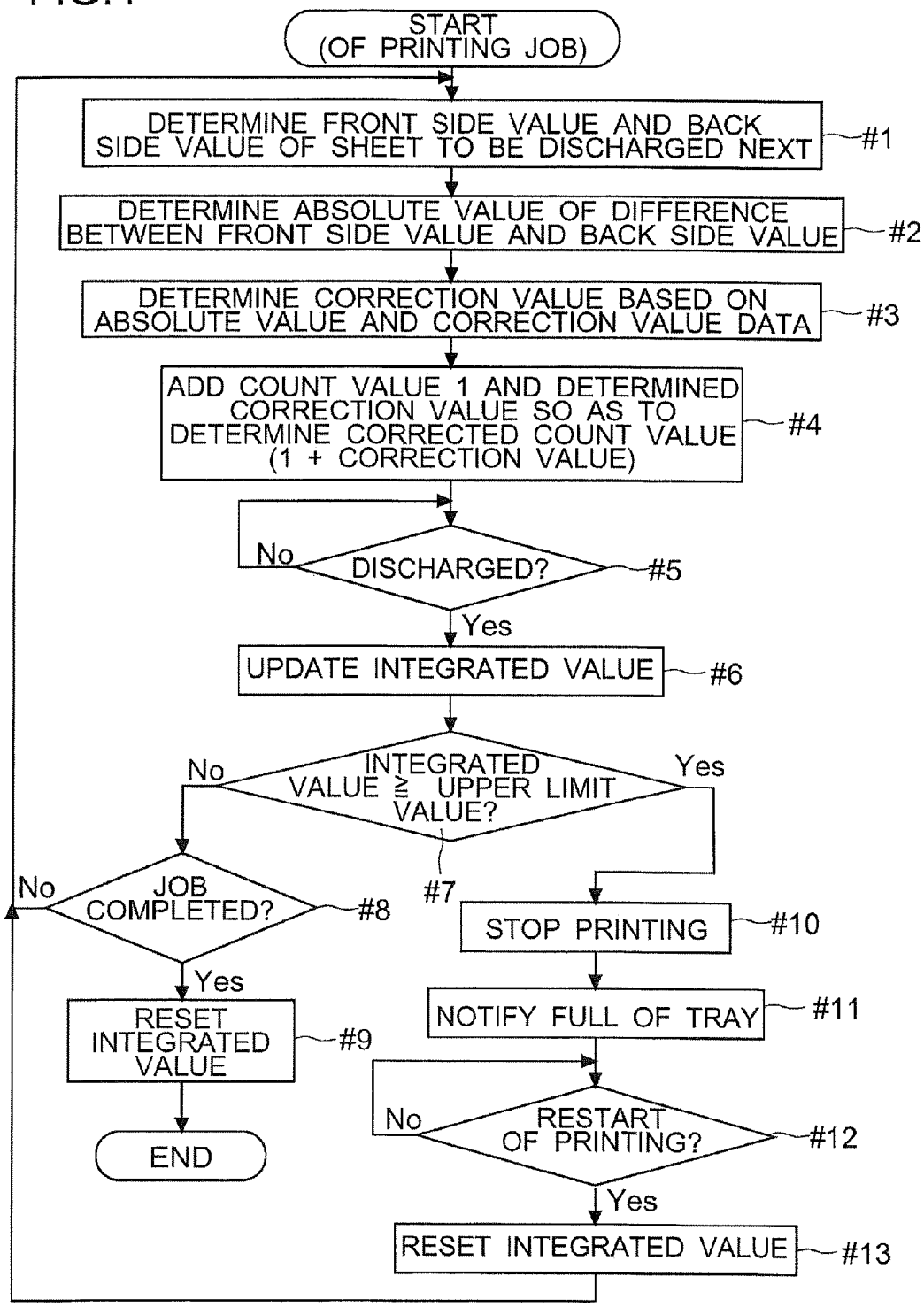
FIG. 4 is a flowchart showing an example of a flow of detecting full of the discharge tray by considering a curl of a sheet of paper.
Figure 6:
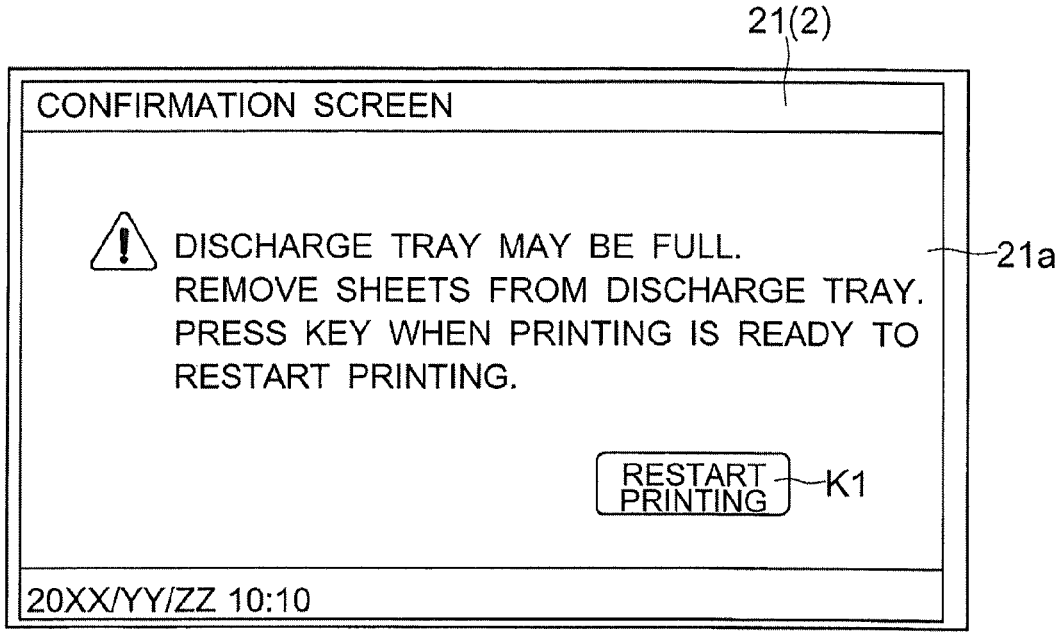
FIG. 6 is a diagram showing an example of a warning screen for full of the discharge tray.

Next, with reference to FIGS. 4 to 6, detection of the full of the discharge tray 4 by considering a curl of the sheet of paper P is described. FIG. 4 is a flowchart showing an example of detection of the full of the discharge tray 4 by considering the curl of the sheet of paper P. FIG. 5 is a diagram showing an example of the correction value data D for determining the correction value. FIG. 6 is a diagram showing an example of a warning screen 21*a* of full of the discharge tray 4.

In the following description, the printed side is regarded as the front side, and the side that is contacted with the pressure roller 13 without a toner image transferred and fixed is regarded as the back side in the simplex printing. In the duplex printing, the side that is first printed (a first side) is regarded as the front side, and the side that is printed second (a second side) is regarded as the back side.

The sheet of paper P is discharged onto the discharge tray 4. When the printing job for printing multiple sheets is performed, the sheets of paper P are sequentially stacked on the discharge tray 4. Further, the thickness of the sheets of paper that can be stacked on the discharge tray 4 has a limitation. When the limitation is exceeded, a part of the stacked sheets of paper P prevent a new sheet of paper P from being discharged from the discharging opening 1*g*. As a result, there is a problem such as occurrence of jamming of the sheet of paper P at a part of the pair of discharge rollers 14 (the discharging opening 1*g*). In order to prevent occurrence of this problem, it is necessary to enable to detect full of the discharge tray 4.

The conventional image forming apparatus counts the number of sheets of paper P discharged onto the discharge tray and detects that the discharge tray is full when the count value becomes a preset upper limit number of sheets. For instance, the count value is incremented by one every time when a sheet of paper is discharged onto the discharge tray. Then, when the upper limit number of sheets is set to 100 for example, it is determined that the discharge tray is full when the count value becomes 100.

Here, when the sheets of paper P has a curl, the height (thickness) of the sheets of paper P stacked on the discharge tray 4 is increased compared with the case where the stacked sheets of paper P has no curl. For this reason, the number of sheets of paper P that can be substantially stacked on the discharge tray 4 when the sheets of paper P have a curl is smaller than that when the sheets of paper P have no curl. Accordingly, it is necessary to take the curl into account when detecting the full of the discharge tray 4 by counting the number of sheets. In addition, as the amount of curl of each sheet of paper P is larger, the height of the sheets of paper P stacked on the discharge tray 4 becomes larger. Thus, it is desired to take the amount of curl (degree of curl) of each sheet of paper P into account when counting the number of sheets. However, the conventional image forming apparatus does not take the curl of the sheet of paper P into account when counting the number of sheets for detecting full of the discharge tray 4.

Unlike the conventional image forming apparatus, the multifunction peripheral 100 of this embodiment determines the value by considering the curl (i.e., a corrected count value) every time when the sheet of paper P is discharged and integrates the corrected count value every time when the sheet of paper P is discharged, so as to detect the full of the discharge tray 4.

This point is described with reference to FIGS. 4 and 5. First, the flow of FIG. 4 starts when the main control unit 5 issues an instruction to the engine control unit 10 so that the printing unit 1 starts the printing job for copping or printing on the basis of data received by the communication unit 53. After that, the main control unit 5 controls the engine control unit 10 and the printing unit 1 to execute the printing job for printing from the first to the last pages of the job.

When the printing is started, the main control unit 5 determines the front side value and the back side value of the sheet of paper P to be discharged next (Step #1). Here, the main control unit 5 determines one of the toner dot count value and the printing rate of the entire surfaces of the front side and the back side of the sheet of paper P to be discharged next as the front side value and the back side value.

First, in the simplex printing, the main control unit 5 (image processing unit 52) counts the number of dots on which toner is deposited on the basis of the image data used for printing (for scanning and exposing the photosensitive drum 16) among the total dots (pixels) of the front side of each sheet of paper P, and controls the storage unit 6 to store the counted value as the toner dot count value (front side value). In contrast, in the simplex printing, because no toner is deposited on the back side of the sheet of paper P, the main control unit 5 always sets zero as the toner dot count value in this case.

On the other hand, in the duplex printing, the main control unit 5 (image processing unit 52) counts the number of dots on which toner is deposited among the total dots (pixels) of the front side of each sheet of paper P on the basis of the image data used for printing, and controls the storage unit 6 to store the counted value as the toner dot count value (front side value). In addition, in the duplex printing, the main control unit 5 (image processing unit 52) counts the number of dots on which toner is deposited among the total dots (pixels) of the back side of each sheet of paper P on the basis of the image data used for printing, and controls the storage unit 6 to store the counted value as the toner dot count value (back side value).

In addition, the printing rate is the value obtained by dividing the number of dots on which toner is deposited in a constant area by the number of total pixels of the constant area (ratio of the number of dots on which toner is deposited to the number of total pixels). For instance, when a text document is printed, the printing rate is usually 4% to 6%. The number of total pixels of one side of one page is determined by a resolution of printing, a size of the sheet of paper, and the like. Also when determining the printing rate, the main control unit 5 determines the toner dot count value of each side of the sheet of paper P. Then, the main control unit 5 determines the printing rates of the front side and the back side of each sheet of paper P by dividing the toner dot count value determined for each side by the number of total pixels of the sheet of paper.

The storage unit 6 stores data defining the number of total pixels of one side of one page of each size of sheet of paper (the front side and the back side have the same number of total pixels). Then, the main control unit 5 refers to the data stored in the storage unit 6 so as to recognize the number of total pixels of one side of one page of the sheet of paper P during printing. The main control unit 5 determines the front side value and the back side value as the printing rates by dividing the counted toner dot count values of the individual sides by the number of total pixels of one side of one page. In this way, the front side value is a value indicating the amount of toner deposited on the front side of the printed sheet of paper P to be discharged next, and the back side value is a value indicating the amount of toner deposited on the back side of the printed sheet of paper P to be discharged next.

Then, the main control unit 5 determines the absolute value of the difference between the front side value and the back side value of the sheet of paper P to be discharged next (Step #2). The main control unit 5 determines the correction value on the basis of the determined absolute value and the correction value data D (Step #3). Further, the main control unit 5 adds the count value (i.e., one in this embodiment) and the determined correction value so as to determine the corrected count value (Step #4).

Next, the main control unit 5 continues to check whether or not a sheet of paper P is discharged onto the discharge tray 4 (whether or not sheets of paper P corresponding to the determined corrected count value are discharged) on the basis of an output of the discharge sensor S3 (Step #5, No in Step #5 to Step #5).

When the sheets of paper P corresponding to the determined corrected count value are discharged (Yes in Step #5), the main control unit 5 adds the corrected count value to the integrated value so as to update the integrated value (Step #6). Then, the main control unit 5 checks whether or not the integrated value has reached a predetermined upper limit value or larger (Step #7).

The upper limit value is a threshold value for determining whether or not the discharge tray 4 has become full and is appropriately determined by considering the number (thickness) of sheets of paper P that can be stacked on the discharge tray 4. For instance, the upper limit value is determined by considering a value obtained by dividing a distance (length) from the surface (bottom surface) of the discharge tray 4 on which the sheets of paper P are placed to the discharging opening 1*g* by a thickness of an average sheet of paper P used in the multifunction peripheral 100 or a sheet of paper P recommended by the manufacturer, or by considering an average amount of curl per one sheet.

Here, with reference to FIG. 5, the correction value is described. FIG. 5 shows examples of the correction value data D indicating a relationship (level) of the correction value with respect to the determined absolute value. The correction value data D of FIG. 5 is used for determining the printing rates of the entire surface of the front side and the entire surface of the back side of the sheet of paper P to be discharged next as the front side value and the back side value.

As shown in FIG. 5, the correction value data D can be defined to be larger as the absolute value of the difference between the printing rates is larger and to be smaller as the absolute value is smaller. As the determined absolute value is larger, a difference of the amount of deposited toner between the front side and the back side is larger. For instance, when a case of printing a solid image (having all pixels on which toner is deposited) on the entire surface of the front side of the sheet of paper in the simplex printing is compared with a case of printing a text document on the front side, a difference of the amount of toner between the front side and the back side is larger in the case of printing the solid image. It is empirically understood that the sheet of paper P on which a solid image is printed has larger amount of curl.

Further, the main control unit 5 set the correction value to a larger value in the case where the amount of curl is recognized to be larger because the absolute value is larger. Because the corrected count value is a value obtained by adding the correction value, the corrected count value becomes larger as the amount of curl is larger. The main control unit 5 compares the integrated value obtained by integrating the corrected count values with the upper limit value, and hence detects full of the discharge tray 4 on the basis of the value on which the amount of curl is reflected (the correction value or the corrected count value).

Specifically, in the duplex printing, it is supposed that the printing rate of the front side is 100%, the printing rate of the back side is 10%, and the absolute value of the difference of the printing rate is 90%. Then, the main control unit 5 calculates 0.9 as the correction value on the basis of correction value data D1. Then, the main control unit 5 (the counter 56 thereof) adds the calculated correction value 0.9 to the count value 1 so as to obtain 1.9 (1+0.9) as the corrected count value. In addition, for example, in the duplex printing, it is supposed that the printing rate of the front side is 5%, the printing rate of the back side is 50%, and the absolute value of the difference of the printing rate is 45%. Then, the main control unit 5 calculates 0.5 as the correction value on the basis of the correction value data D1. Further, the main control unit 5 (the counter 56 thereof) adds the calculated correction value 0.5 to the count value 1 so as to obtain 1.5 (1+0.5) as the corrected count value. In this way, the correction value is determined in accordance with the determined absolute value (estimated amount of curl of the sheet of paper).

Then, the main control unit 5 determines the correction value and the corrected count value for each sheet of paper to be discharged next onto the discharge tray 4, and the main control unit 5 (the counter 56 thereof) integrates the corrected count value in the same printing job. For instance, when the sheets of paper having the corrected count value of 1.9 are continuously discharged, the main control unit 5 determines that the discharge tray becomes full at the number of sheets that is 1/1.9 of the normal number of sheets. In addition, for example, when the sheets of paper having the corrected count value of 1.5 are continuously discharged, the main control unit 5 determines that the discharge tray becomes full at the number of sheets that is 1/1.5 (⅔) of the normal number of sheets.

In addition, when the dot count values of the entire surfaces of the front side and the back side of the sheet of paper P to be discharged next are determined as the front side value and the back side value, the correction value data for the dot count value can be determined (not shown). As to the correction value data for the dot count value, the dot count value corresponding to the printing rate shown in FIG. 5 is determined in advance. Here, the front side and the back side of the sheet of paper have the same number of dots of the entire page. The number of dots of the entire page is temporarily denoted by "A1". A value of "A1" corresponds to the resolution of printing and the size of the sheet of paper.

The dot count value corresponding to a printing rate of 1% shown in FIG. 5 is calculated as A1×0.01. Similarly, the dot count value corresponding to a printing rate of 0% is calculated as A1×0, the dot count value corresponding to a printing rate of 10% is calculated as A1×0.1, the dot count value corresponding to a printing rate of 20% is calculated as A1×0.2, the dot count value corresponding to a printing rate of 30% is calculated as A1×0.3, the dot count value corresponding to a printing rate of 40% is calculated as A1×0.4, the dot count value corresponding to a printing rate of 50% is calculated as A1×0.5, the dot count value corresponding to a printing rate of 60% is calculated as A1×0.6, the dot count value corresponding to a printing rate of 70% is calculated as A1×0.7, the dot count value corresponding to a printing rate of 80% is calculated as A1×0.8, the dot count value corresponding to a printing rate of 90% is calculated as A1×0.9, and the dot count value corresponding to a printing rate of 100% is calculated as A1. As to the correction value data for the dot count value, a plurality of dot count values corresponding to the printing rates shown in FIG. 5 are determined. The dot count values corresponding to other printing rates can be calculated and determined in the same manner.

Specifically, in the duplex printing, it is supposed that the dot count value of the front side is a dot count value corresponding to a printing rate of 80%, and the dot count value of the back side is a dot count value corresponding to a printing rate of 20%. Then, the absolute value of the difference between the dot count values is a dot count value corresponding to a printing rate of 60%, and therefore the main control unit 5 calculates the correction value as 0.6 in accordance with the correction value data of the printing rate. Then, the main control unit 5 (the counter 56 thereof) adds the calculated correction value 0.6 to the count value 1 so as to obtain 1.6 (1+0.6) as the corrected count value.

As shown in FIG. 5, the correction value data D to be used may be different between the duplex printing and the simplex printing. FIG. 5 shows an example of the correction value data D (i.e., correction value defining table) of the image forming apparatus (multifunction peripheral 100) in which the amount of curl is apt to be larger in the duplex printing. In this type, the correction value data D is defined (adjusted) so that the correction value is larger in the duplex printing than in the simplex printing when the determined absolute value (absolute value of the difference between the front side value and the back side value) is the same. FIG. 5 shows an example of defining the correction value data D1 for the duplex printing and the correction value data D2 for the simplex printing so that the correction value for the simplex printing is approximately a half of that for the duplex printing.

Note that a possibility that the amount of curl is smaller in the duplex printing than in the simplex printing is not zero. The possibility depends on characteristics of the image forming apparatus and characteristics of the toner. In view of such a circumstance, the correction value data D may be defined so that the correction value for the simplex printing is larger than that for the duplex printing when the determined absolute value (absolute value of the difference between the front side value and the back side value) is the same. In other words, it is possible to prepare the correction value data D2 for the simplex printing and the correction value data D1 for the duplex printing by considering tendencies of curl in the simplex printing and the duplex printing. In this way, it is possible to prepare a plurality of correction value data D and to selectively use one of them depending on a case.

In addition, when a plurality of correction value data D (correction value defining tables) are prepared, the operation panel 2 may accept an input for setting the correction value data D to be used in the simplex printing and an input for setting the correction value data D to be used in the duplex printing. In this case, the main control unit 5 calculates the correction value by using the set correction value data D in the simplex printing and in the duplex printing.

When the integrated value is lower than the upper limit value (No in Step #7), the main control unit 5 checks whether or not the printing job is finished with the sheet of paper P discharged just before (in the job for printing only one page) or with the sheet of paper to be discharged next (in a job for printing a plurality of pages) (Step #8). In other words, the main control unit 5 checks whether or not to finish the detection of full of the discharge tray 4.

When the printing job is finished (Yes in Step #8), it is not necessary to continue to detect full of the discharge tray 4. Accordingly, the main control unit 5 (CPU 51) resets the integrated value (Step #9), and this flow is finished (END).

In this flowchart, the integrated value is reset every time when the printing job is finished. However, the printing job may be successively executed when a plurality of printing jobs are accumulated in the multifunction peripheral 100 (e.g., when receiving a print job during copying). In this case, the time from the end of the printing job to the start of the next printing job is a predetermined time or shorter. The next printing job is executed without a pause. In this case, the main control unit 5 may not reset the integrated value but inherit the integrated value of the last printing job, so as to integrate the corrected count value of the new printing job from the integrated value of the last printing job. When the integrated value is not reset, the main control unit 5 may reset the integrated value when a predetermined time elapses from the end of the printing job without starting the next printing job.

On the other hand, when the printing job is not finished yet (when there is another sheet of paper P to be discharged, i.e., No in Step #8), the flow returns to Step #1.

On the other hand, when the integrated value becomes the upper limit value or larger (Yes in Step #7), the main control unit 5 controls the printing unit 1 to stop printing in order to avoid occurrence of a problem such as jamming (Step #10). The main control unit 5 controls to stop various processes in the multifunction peripheral 100, such as conveying and feeding of the sheet of paper, forming and fixing of the toner image, and the like.

Further, the main control unit 5 controls the operation panel 2 to perform warning notification of full of the discharge tray 4 (Step #11). Specifically, the main control unit 5 controls the display unit 21 to display the warning screen 21*a* of full of the discharge tray 4 as shown in FIG. 6. As shown in FIG. 6, the warning screen 21*a* can include a message indicating that the discharge tray 4 is full and a message urging to remove the sheets of paper P on the discharge tray 4. Further, the main control unit 5 may control the display unit 21 to display a message urging to remove the sheet of paper P remaining inside the multifunction peripheral 100 because of the stop of printing.

Then, the main control unit 5 continues to check whether or not the printing can be restarted (Step #12, No in Step #12 to Step #12). A print restart key K1 is displayed in the warning screen 21*a*. The main control unit 5 determines that the printing can be restarted under the condition that the display position the print restart key K1 is touched in the state where none of the sheet detection sensors detects the sheet of paper P.

When it is determined that the printing can be restarted (Yes in Step #12), it is estimated that the sheets of paper P are removed from the discharge tray 4, and hence the main control unit 5 resets the integrated value (Step #13). Then, the flow returns to Step #1.

(Variation)

Figure 7:
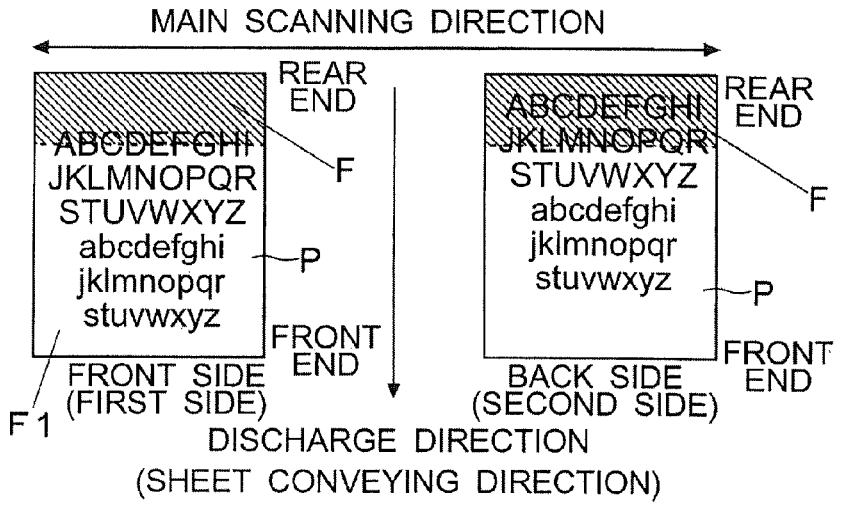
FIG. 7 is a diagram showing an example of a difference of an amount of toner between both sides.
Figure 8:
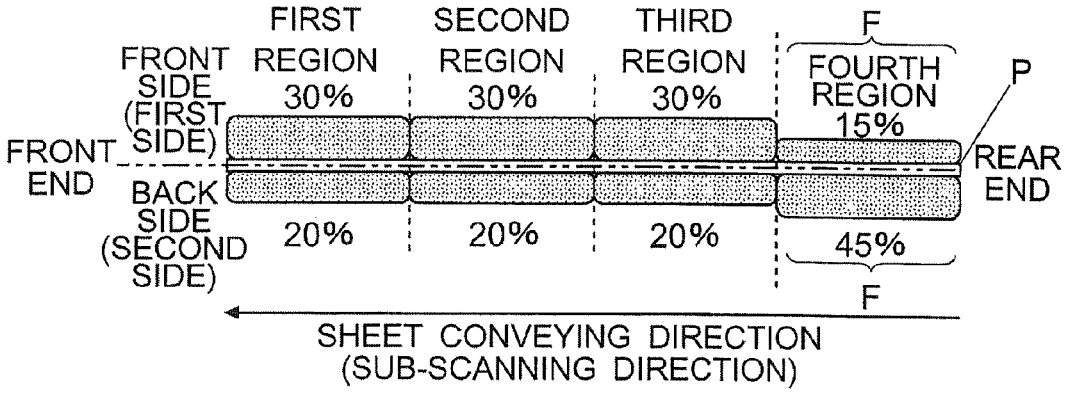
FIG. 8 is a diagram showing an example of a difference of an amount of toner between both sides.

Next, a variation of the embodiment of the present disclosure is described with reference to FIGS. 7 and 8. FIG. 7 is an explanatory diagram showing an example of the dot count in the variation. FIGS. 7 and 8 are diagrams showing an example of the difference of the amount of toner between both sides.

In particular, the rear end part in the sheet conveying direction (upstream end in the sheet conveying direction) of the sheet of paper P on the discharge tray 4 becomes an obstacle for discharging a new sheet of paper. In other words, when the discharge tray 4 is full, the rear end part of the top sheet of paper P on the discharge tray 4 abuts the new sheet of paper P to be discharged.

The embodiment described above shows the example in which the front side value and the back side value are determined with respect to the entire surface of the front side of the sheet of paper P, and the absolute value, the correction value, and the corrected count value are determined with respect to the entire surface (one page) of the sheet of paper P. On the other hand, when the discharge tray 4 is becoming full, the amount of curl of the rear end part of each sheet of paper P on the discharge tray 4 largely affects whether or not another sheet of paper P can be discharged. For this reason, in this variation, the main control unit 5 regards a predetermined range of the rear end part in the sheet conveying direction of the front side of the sheet of paper P as a target region F for which the front side value is determined. In addition, the main control unit 5 regards a predetermined range of the rear end part in the sheet conveying direction of the back side of the sheet of paper P as the target region F for which the back side value is determined.

Specifically, an example of a target range for which the front side value and the back side value are determined is described with reference to FIG. 7. FIG. 7 shows an example in the case of the duplex printing. The horizontal direction in FIG. 7 corresponds to a main scanning direction (perpendicular to the sheet conveying direction). In addition, the lower side of FIG. 7 corresponds to a downstream side in the sheet conveying direction (a front end of the sheet of paper P). Because a switch back is performed in the duplex printing, the sheet of paper P is discharged onto the discharge tray 4 not from the upper side (of the front side) but from the lower side (of the front side).

Then, the main control unit 5 regards a predetermined range of the rear end part in the sheet conveying direction of the front side of the sheet of paper P as the target region F for which the front side value is determined, and regards a predetermined range of the rear end part in the sheet conveying direction of the back side of the sheet of paper P as the target region F for which the back side value is determined. Further, in the case of the simplex printing, the main control unit 5 regards the back side value as zero in the same manner as described above.

The target range can be determined appropriately. For instance, the target range can be determined as a banding range of ¼ length of the sheet of paper P from the rear end of the sheet of paper P in the conveying direction (that is an area of approximately ¼ of the sheet of paper P including both corners on the rear end of the sheet of paper and contacting with the rear end side of the sheet of paper P). In FIG. 7, the target range is shown with dots. The area of the target range is not limited to ¼ of the sheet of paper P, and the shape thereof is not limited to a rectangular shape but is appropriately determined. In other words, the main control unit 5 divides the surface of the front side or the back side of the sheet of paper into predetermined regions along the sheet conveying direction, and regards the rear end region among the divided regions as the target region F for which the front side value or the back side value is determined.

Also in this variation, the main control unit 5 can obtain the toner dot count value or the printing rate as the front side value and the back side value on the basis of the image data used for printing (for scanning and exposing the photosensitive drum 16). Then, in this variation, the main control unit 5 determines not the dot count value of the entire sheet of paper but the dot count value of the predetermined range (target region F) including the rear end in the sheet conveying direction. In addition, when determining the printing rate, the main control unit 5 divides the toner dot count value of the target region F on each side of the sheet of paper P by the number of dots of the entire target region F so as to determine the printing rates of the front side and the back side. Note that the front side and the rear side have the same area of the target region F and the same number of dots of the target region F in printing.

More specifically, the description is added FIG. 8. In addition, in the example of FIG. 8, the main control unit 5 determines the front side value and the back side value only for the region of the rear end part (including the rear end). FIG. 8 shows an example of the amount of toner deposited on both sides of the sheet of paper P in the duplex printing. In the multifunction peripheral 100 of this embodiment, the sheet of paper P is discharged with the side that is printed last (i.e., the front side in the simplex printing or the back side in the duplex printing) facing downward. Accordingly, in FIG. 8 showing the duplex printing, the front side is the upper side while the back side is the lower side.

In addition, in the example shown in FIG. 8, the area of one side of the sheet of paper P is uniformly divided into four regions in the sheet conveying direction. FIG. 8 shows the example in which toner is deposited on 30% of the total dots in each of the first, second and third regions from the front end of the front side. In addition, FIG. 8 shows the example in which toner is deposited on 15% of the total dots in the part including the rear end of the front side.

On the other hand, FIG. 8 shows the example in which toner is deposited on 20% of the total dots in the first, second and third regions from the front end of the back side. In addition, FIG. 8 shows the example in which toner is deposited on 45% of the total dots in the part including the rear end of the back side.

According to the embodiment described above, the printing rate of the entire sheet of paper P (page) is determined as the front side value or the back side value in the duplex printing. Accordingly, the main control unit 5 obtains a front side value of 26.25% ((30+30+30+15)/4) and a back side value of 26.25% ((20+20+20+45)/4). In this case, the main control unit 5 obtains the absolute value of the difference as zero. Then, the main control unit 5 refers to the correction data (see FIG. 5) and determines the correction value to be zero. As a result, the main control unit 5 determines the corrected count value of this page as 1 (i.e., no correction).

On the other hand, in this variation, the region including the rear end (on the upstream side in the sheet conveying direction) of the sheet of paper P is determined as the target region F. Then, when determining the printing rate as the front side value or the back side value, the main control unit 5 obtains the printing rate of the front side as 15% and the printing rate of the back side as 45%. In this case, the main control unit 5 calculates the absolute value of the difference as $|15-45|=30$. Then, the main control unit 5 refers to the correction data (as shown in FIG. 5) so as to obtain the correction value to be 0.3 or 0.15. In addition, the main control unit 5 obtains the corrected count value of this page to be 1.3 or 1.15.

In this way, the region of one page of the sheet of paper P for which the front side value or the back side value is determined is limited to the rear end. Consequently, it is possible to detect the full of the discharge tray 4 while considering an amount of curl on the rear end side in the sheet conveying direction.

In addition, when determining the dot count values of the rear end regions (target regions) of the front side and the rear side of the sheet of paper P to be discharged next as the front side value and the back side value, the dot count value of the correction value data is a value corresponding to an area of the target region.

As to the correction value data of the rear end region as the target region F, i.e., the correction value data when determining the absolute value of the difference of the dot count value, dot count value corresponding to the printing rate and the area of the target region F is determined in advance. Here, the front side and the back side of the sheet of paper have the same number of dots in the target region F. The total number of dots in the target region F is supposed to be A2. A value of A2 corresponds to the area of the target region F, a resolution of printing, and a size of the sheet of paper.

The dot count value corresponding to a printing rate of 1% shown in FIG. 5 is calculated as A2×0.01. Similarly, the dot count value corresponding to a printing rate of 0% is calculated as A2×0, the dot count value corresponding to a printing rate of 10% is calculated as A2×0.1, the dot count value corresponding to a printing rate of 20% is calculated as A2×0.2, the dot count value corresponding to a printing rate of 30% is calculated as A2×0.3, the dot count value corresponding to a printing rate of 40% is calculated as A2×0.4, the dot count value corresponding to a printing rate of 50% is calculated as A2×0.5, the dot count value corresponding to a printing rate of 60% is calculated as A2×0.6, the dot count value corresponding to a printing rate of 70% is calculated as A2×0.7, the dot count value corresponding to a printing rate of 80% is calculated as A2×0.8, the dot count value corresponding to a printing rate of 90% is calculated as A2×0.9, and the dot count value corresponding to a printing rate of 100% is calculated as A2.

Specifically, in the duplex printing, it is supposed that the dot count value of the target region F of the front side is the dot count value corresponding to a printing rate of 15% (A2×0.15) while the dot count value of the target region F of the back side is the dot count value corresponding to a printing rate of 4% (A2×0.04). Then, the absolute value of the difference between the dot count values is the dot count value corresponding to a printing rate of 11%. Accordingly, the main control unit 5 determines the correction value to be 0.2 in accordance with the correction value data of the printing rate. Then, the main control unit 5 adds the determined correction value of 0.2 to the count value of 1 so as to obtain 1.2 (1+0.2) as the corrected count value and integrates the corrected count value.

In the present disclosure, when detecting full of the discharge tray on the basis of the count, curl of each sheet of paper is considered for performing the integration, so as to detect the full of the discharge tray at an appropriate timing. Specifically, the image forming apparatus (multi-function peripheral 100) according to the embodiment includes the discharge tray 4, the printing unit 1 including the duplex printing mechanism for performing the duplex printing so as to print on both sides of the sheet of paper P and to discharge the printed sheet of paper P onto the discharge tray 4, the stacking controlling unit (main control unit 5) including the counter 56 for integrating a value, so as to obtain the front side value related to an amount of toner deposited on the front side of the printed sheet of paper P and the back side value related to an amount of toner deposited on the back side of the sheet of paper P, and to determine the absolute value of the difference between the front side value and the back side value for each sheet of paper P, and the storage unit for storing the correction value data D in which the correction value is determined to be larger as the absolute value is larger. The stacking controlling unit determines the correction value of each sheet of paper discharged onto the discharge tray 4 on the basis of the determined absolute value and the correction value data D, integrates the corrected count value obtained by correcting the count value incremented by one every time when the sheet of paper is discharged by the correction value so as to determine the integrated value, and detects full of the discharge tray 4 when the integrated value reaches a predetermined upper limit value.

In this way, it is possible to integrate the value by considering curl of each sheet of paper P by adding a large correction value when the curl is large while adding a small correction value when the curl is small. Thus, it is possible to avoid detection of the full of the discharge tray 4 after the discharged sheets of paper P block the discharging opening 1*g* for the sheet of paper P.

In addition, instead of weighting by considering a uniform value of curl of the sheet of paper P, a variation of the degree of curl (amount of curl) among the sheets of paper P is reflected on the value while the integrated value is integrated. In this way, because the integration is performed by considering a degree of curl of each sheet of paper P, a variation of the thickness of the sheets of paper stacked on the discharge tray 4 becomes small when full of the discharge tray 4 is detected. Accordingly, without disposing a sensor for detecting full of the discharge tray 4, the height or thickness of the sheets of paper P to be stacked on the discharge tray 4 can be used fully, and hence full of the discharge tray 4 can be always detected when the discharge tray 4 becomes substantially full.

The stacking controlling unit (main control unit 5) determines the front side value of the entire front side of the sheet of paper and determines the back side value of the entire back side of the sheet of paper. Alternatively, the stacking controlling unit divides one of the front side and the back side of the sheet of paper P into a predetermines regions along the sheet conveying direction and uses the rearmost region among the divided regions as the target region F for determining the front side value and the back side value of the sheet of paper.

When the front side value and the back side value are determined with respect to the entire front side and the entire back side of the sheet of paper P, it is possible to determine the correction value by considering an average tendency of curl of the entire sheet of paper P. On the other hand, when the front side value and the back side value are determined with respect to the range of the predetermined rear part in the sheet conveying direction, it is also possible to determine the correction value by noting the amount of curl on the rear end side of the sheet of paper P in the conveying direction (the upstream side in the sheet conveying direction) of the sheet of paper P in accordance with a distance to the discharging opening 1*g* and a relationship with an interference of the sheet of paper P discharged from the discharging opening 1*g*.

In addition, the stacking controlling unit (main control unit 5) determines one of the dot count value obtained by counting the number of dots on which toner is deposited among the dots in the target region F and the printing rate that is a ratio of the dot count value of the target region F to the total number of dots of the target region F as the front side value and the back side value.

The amount of curl is affected by deviation of amount of toner deposited on each side of the sheet of paper P. Then, values indicating amounts of toner deposited on both sides of the sheet of paper P are obtained as the front side value and the back side value. On the basis of the determined front side value and the back side value, the correction value is determined, and the integrated value is integrated. Accordingly, it is possible to detect full of the discharge tray 4 by considering the curl based on the influence of the deviation of the amount of toner.

In addition, the printing unit 1 includes the duplex printing mechanism for performing the duplex printing (the discharge conveying unit 1*e* and the duplex conveying unit 1*f*). The storage unit 6 stores the correction value data D1 for the duplex printing and the correction value data D2 for the simplex printing. The stacking controlling unit (main control unit 5) determines the correction value by using the correction value data D2 for the simplex printing when the printing unit 1 performs the simplex printing, and determines the correction value by using the correction value data D1 for the duplex printing when the printing unit 1 performs the duplex printing. Further, the correction value data D1 for the duplex printing and the correction value data D2 for the simplex printing are determined so that the correction value is different between the simplex printing and the duplex printing when the determined absolute values are the same.

The amount of curl in the duplex printing may be different from that in the simplex printing because the sheet of paper passes through a fixing device a plurality of times (i.e., is pressed and heated more times) in the duplex printing. For this reason, a larger or smaller correction value to be added is used in the duplex printing. As a result, it is possible to determine the correction value by considering a difference between the duplex printing and the simplex printing. Accordingly, it is possible to detect full of the discharge tray 4 at an appropriate timing when one of the simplex printing and the duplex printing is performed.

In addition, the image forming apparatus (multifunction peripheral 100) according to the embodiment includes the informing unit for performing notification (display unit 21). Further, when detecting full of the discharge tray 4, the stacking controlling unit (main control unit 5) controls the informing unit to notify that the discharge tray 4 is full and controls the printing unit 1 to stop printing and further discharging of the sheet of paper P onto the discharge tray 4.

Thus, it is possible to urge the user to remove the sheets of paper P stacked on the discharge tray 4. In addition, when full of the discharge tray 4 is detected, the sheets of paper P discharged and stacked may prevent a new sheet of paper P from being discharged. As a result, there is a high possibility that jamming occurs. In other words, jamming is about to occur at the discharging opening 1*g* and its vicinity. When jamming occurs, it is troublesome to eliminate the jamming. However, because the printing is stopped when full of the discharge tray 4 is detected, the user is not bothered. Thus, a user-friendly image forming apparatus (multifunction peripheral 100) can be provided.

Although the embodiment of the present disclosure is described above, the present disclosure is not limited to the embodiment but can be modified variously within the scope without deviating from the spirit of the disclosure.

In the example described above, as for each sheet of paper of the same printing job, the main control unit 5 adds the determined correction value to the count value 1 so as to obtain the corrected count value, and the main control unit 5 (counter 56) integrates (adds sequentially) the corrected count value of each sheet of paper of the same printing job. However, it is possible to obtain the corrected count value by multiplying the count value by the correction value. In this case, it is supposed that the absolute value of the difference of the printing rate between the front side and the back side in the duplex printing is 5, for example (see FIG. 5). Then, the correction value is determined to be 0.1, and the corrected count value is determined to be 1.1. When determining the corrected count value by multiplication similarly to the case of determining by addition, the correction value is 1.1. In other words, when determining the corrected count value by multiplying the count value by the correction value, the correction value should be a value obtained by adding one to the correction value shown in FIG. 5.

What is claimed is:

1. An image forming apparatus, comprising:

a discharge tray;

a printing unit including an image forming unit for forming a toner image and transferring the toner image to a sheet of paper, a fixing unit for applying heat and pressure to the toner image to fix the toner image to the sheet of paper, and a duplex printing mechanism for performing duplex printing, the printing unit discharging the printed sheet of paper onto the discharge tray;

a stacking controlling unit including a counter for integrating a value, the stacking controlling unit being configured to determine a front side value related to an amount of toner deposited on a front side of the printed sheet and a back side value related to an amount of toner deposited on a back side of the sheet, to determine an absolute value of a difference between the front side value and the back side value of each sheet of paper, to determine a correction value of each sheet of paper discharged onto the discharge tray on the basis of the determined absolute value and correction value data, to integrate a corrected count value obtained by correcting a count value incremented by one every time when the sheet of paper is discharged by the correction value so as to determine an integrated value, and to detect full of the discharge tray when the integrated value reaches a predetermined upper limit value; and a storage unit for storing the correction value data in which the correction value is determined to be larger as the absolute value is larger, a display unit for displaying menus and software keys for accepting settings and operation instructions, and a plurality of sheet detection sensors for detecting a conveying situation of the sheet of paper, the plurality of sheet detection sensors being disposed along a conveying path for the sheet of paper, wherein the plurality of sheet detection sensors at least include a registration sensor disposed before the image forming unit, a fixing sensor disposed at an entrance of the fixing unit, and a discharge sensor disposed in a vicinity of a discharging opening, the stacking controlling unit divides a surface of the front side and the back side of the sheet of paper along a line parallel to a main scanning direction into predetermined regions, and regards, out of the divided regions, a region including a rear end of the sheet of paper as a target region of the sheet of paper for determining the front side value and the back side value, the storage unit stores the correction value data for duplex printing and the correction value data for simplex printing, the stacking controlling unit determines the correction value by using the correction value data for simplex printing when the printing unit performs the simplex printing and determines the correction value by using the correction value data for duplex printing when the printing unit performs the duplex printing, and the correction value data for duplex printing and the correction value data for simplex printing are determined so that, when the determined absolute values are the same, the correction value data for duplex printing is larger than the correction value data for simplex printing, when the integrated value is equal to or larger than the upper limit value, the stacking controlling unit makes the display unit display a warning screen including a warning of fullness of discharge tray and a print restart key, and under a condition that a display position of the print restart key is touched in a state where none of the plurality of sheet detection sensors detects presence of the sheet of paper, the stacking controlling unit makes the printing unit restart printing.

2. The image forming apparatus according to claim 1, wherein, the stacking controlling unit divides a surface of the front side and the back side of the sheet of paper along a sheet conveying direction into predetermined regions, and regards a rear region among the divided regions as a target region of the sheet of paper for determining the front side value and the back side value.

3. The image forming apparatus according to claim 2, wherein, the stacking controlling unit determines one of a dot count value of dots on which toner is deposited in the target region and a printing rate that is a ratio of the dot count value to the total number of dots of the target region as the front side value and the back side value.

4. The image forming apparatus according to claim 1, further comprising an informing unit for performing notification, wherein when full of the discharge tray is detected, the stacking controlling unit controls the informing unit to notify that the discharge tray is full and controls the printing unit to stop printing and further discharging of the sheet of paper onto the discharge tray.

5. A method for controlling an image forming apparatus, comprising the steps of:

determining a front side value related to an amount of toner deposited on a front side of a sheet of paper and a back side value related to an amount of toner deposited on a back side of the sheet of paper;

determining an absolute value of a difference between the front side value and the back side value of each sheet of paper;

determining a correction value of each sheet of paper discharged onto a discharge tray on the basis of the determined absolute value and correction value data in which the correction value is determined to be larger as the absolute value is larger;

integrating a corrected count value obtained by correcting a count value incremented by one every time when the sheet of paper is discharged by the correction value so as to determine an integrated value;

detecting full of the discharge tray when the integrated value reaches a predetermined upper limit value;

dividing a surface of the front side and the back side of the sheet of paper along a line parallel to a main scanning direction into predetermined regions, and regarding, out of the divided regions, a region including a rear end of the sheet of paper as a target region of the sheet of paper for determining the front side value and the back side value;

storing the correction value data for duplex printing and the correction value data for simplex printing;

displaying menus and software keys for accepting settings and operation instructions;

disposing a plurality of sheet detection sensors for detecting a conveying situation of the sheet of paper, along a conveying path for the sheet of paper;

disposing, as the plurality of sheet detection sensors, at least a registration sensor disposed before an image forming unit, a fixing sensor disposed at an entrance of a fixing unit, and a discharge sensor disposed in a vicinity of a discharging opening, determining the correction value by using the correction value data for simplex printing when the printing unit performs the simplex printing and determining the correction value by using the correction value data for duplex printing when the printing unit performs the duplex printing; and determining the correction value data for duplex printing and the correction value data for simplex printing so that, when the determined absolute values are the same, the correction value data for duplex printing is larger than the correction value data for simplex printing, displaying a warning screen including a warning of fullness of discharge tray and a print restart key when the integrated value is equal to or larger than the upper limit value, and restarting printing under a condition that a display position of the print restart key is touched in a state where none of the plurality of sheet detection sensors detects presence of the sheet of paper.

* * * * *